United States Patent [19]

Dlugopolski

[11] 4,134,497

[45] Jan. 16, 1979

[54] SHOCK ABSORBING CARTON INSERT

[75] Inventor: Joseph Dlugopolski, Chicago, Ill.

[73] Assignee: Fidelity Container Corp., Elk Grove Village, Ill.

[21] Appl. No.: 823,436

[22] Filed: Aug. 10, 1977

[51] Int. Cl.[2] ..... B65D 81/14

[52] U.S. Cl. ..... 206/521; 206/491; 229/40

[58] Field of Search ..... 229/14 C, DIG. 11, 40, 229/43; 206/44.12, 45.31, 320, 491, 521, 424, 586

[56] References Cited

U.S. PATENT DOCUMENTS

| | | | |
|---|---|---|---|
| 3,048,323 | 8/1962 | Stauffer | 229/14 C |
| 3,116,154 | 12/1963 | Rumsey, Jr. | 206/45.31 |
| 3,211,359 | 10/1965 | Fickes | 229/40 |
| 3,219,256 | 11/1965 | Zastrow | 229/40 |
| 3,302,779 | 2/1967 | Sparks | 206/45.31 |
| 3,337,113 | 8/1967 | Harrison | 206/491 |
| 3,386,642 | 6/1968 | Young | 229/40 |
| 3,446,419 | 5/1969 | Mueller | 229/40 |
| 3,790,065 | 2/1974 | Carpenter | 206/424 |
| 3,871,572 | 3/1975 | Skaggs | 229/40 |
| 3,966,113 | 6/1976 | Tipton | 229/40 |

*Primary Examiner*—William Price
*Assistant Examiner*—Bruce H. Bernstein
*Attorney, Agent, or Firm*—Laff, Whitesel & Rockman

[57] ABSTRACT

A preferably corrugated cardboard, shock-absorbing carton insert completely surrounds a product except for the top which is open to display the product to view. The insert is made from a corrugated cardboard blank having preformed score and cut lines which enable the blank to fold into a generally rectangular box having enlarged end panels that support the box in a position which is spaced away from all adjacent structures. There is a V-shaped fold between the box and each of its end panels to provide greater rigidity and further strength. Tab ends are positioned between the box and the end panel to help absorb a shock in any direction. The corrugated cardboard automatically assumes a desired end-product configuration responsive to four simple folding motions.

5 Claims, 10 Drawing Figures

SHOCK ABSORBING CARTON INSERT

This invention relates to structures for packaging delicate equipment and more particularly to shock-absorbing carton inserts for supporting electronic or similar appliances while they are packaged inside another box, such as a shipping or a display box.

Certain appliances are conventionally packaged, shipped, distributed and sold in a variety of different ways, such as in individual display boxes or in bulk packages containing, say, six individual appliances. Usually, the individual display boxes have a decorative appearance so that they provide attractive point of sale advertisement. As a practical matter, this means that the display boxes must be made from a relatively thin stock which is able to pass through a printing press. Therefore, the display box has little or no shock-absorbing qualities to protect the enclosed appliance. When a bulk package is used, the appliance itself may form the attractive and decorative appearance for point of sale advertisement, but the appliance will still be supported by some kind of a protective structure.

To overcome the resulting problems for either of these packaging techniques, it is customary to provide a relatively large and strong corrugated carton insert or packing insert which may be fitted snugly into the display box or covered by a heat shrink plastic sleeve when used in a bulk container. The carton insert is shaped and dimensioned to protect, cradle, and support an appliance contained within the box. The carton insert should have as low a cost as possible, should be easy to manufacture, and simple to use. It should fold or otherwise be formed into the desired insert configuration, quickly, easily, and at a very low cost. The importance of these considerations is best realized when one stops to consider that at least one, and sometimes more, individual carton inserts are required for every appliance sold. Therefore, any added increment of cost or inconvenience must be multiplied by the total number of appliances that are sold. This is distinguished from other packaging techniques where a number of products may share the cost of a single shipping container.

Therefore, as a generality, any improvement which constitutes a savings in an individually used container or carton insert is an important step forward because the savings are multiplied by the total number of products sold. Likewise, any improvement in such an individual container or carton insert which results in fewer damages to products in shipment and storage is also a substantial step forward.

Accordingly, an object of this invention is to provide new and improved packing or carton inserts. Here, an object is to provide corrugated cardboard inserts which have better shock-absorbing qualities than were heretofore available, at a comparable cost. In particular, an object is to provide novel, self-locking, self-supporting inserts which surround and support an electronic appliance.

Yet another object is to provide a convenient, shock-absorbing structure which is convenient both to originally package a product or to enter for product removal.

Still another object is to provide a shock-absorbing carton insert which completely surrounds a product, except for the top of the insert, which top is open to display the product to view.

In keeping with an aspect of the invention, these and other objects are accomplished by providing a corrugated cardboard blank having both score and cut lines which enable the blank to fold into a generally rectangular box with enlarged end panels. This box cradles and supports the product in a position which is spaced away from all adjacent structures. There is a V-shaped fold in the corrugated cardboard, at a position between the box and each of its end panels, to provide greater rigidity and further strength. Tab ends on the box are positioned between the box and the end panel to absorb the force of a blow. Thus, if the product receives a shock in any direction, the corrugated cardboard must collapse before it will be damaged.

The nature of the invention will become more apparent from a study of the attached drawings wherein.

Figure 1:
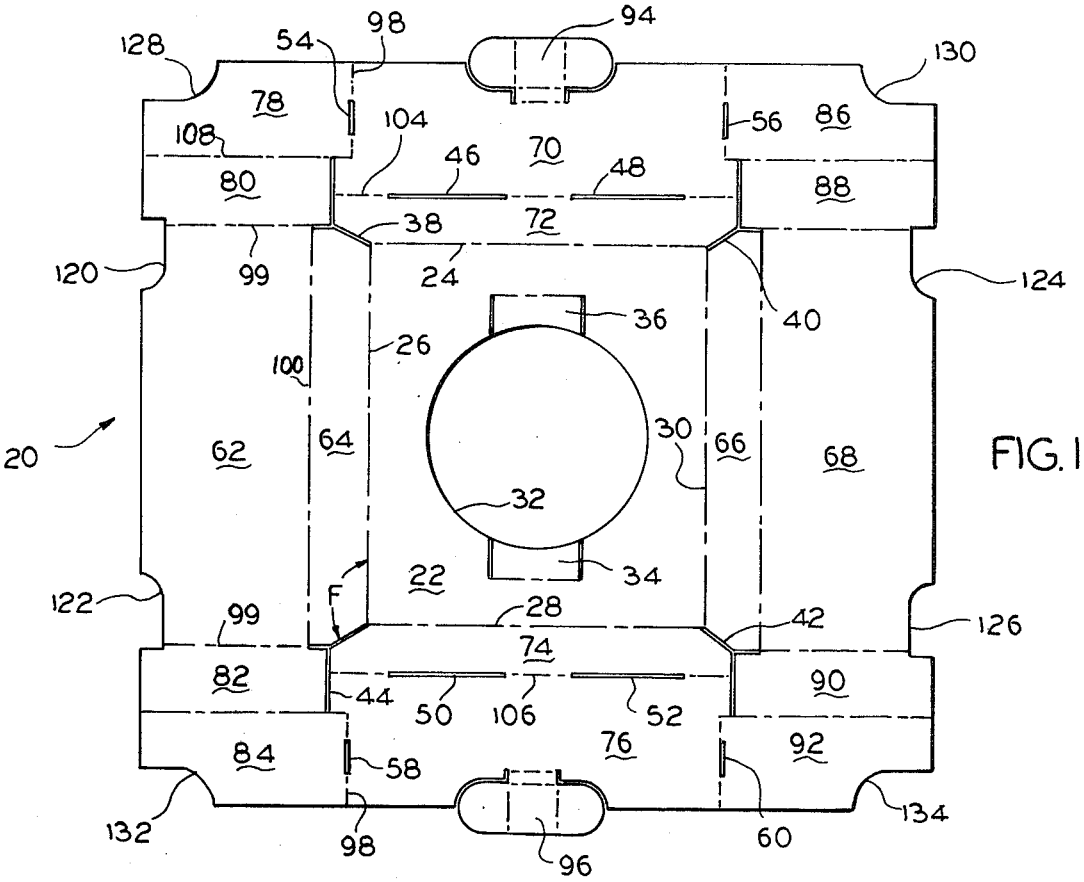
FIG. 1 is a plan view of a preferably corrugated cardboard blank for making the inventive carton insert.

The blank 20 for making the folded carton insert is best seen in FIG. 1. There is a central panel 22 defined by a plurality of score lines 24,26,28,30 and containing a circular hole 32 through which a portion of the electrical appliance may project or be seen. Positioning or indexing tabs 34,36 are cut into the sides of the hole 32 to receive, position, and center the appliance and to stabilize it against movement within the box.

Semi-piercing rule dies are used to form score lines and to cut through the blank 20. The cuts are formed at points 38–60 where the folding cardboard would otherwise form undue bulk, bind, or prevent smooth folds. In FIG. 1, dashed lines are used to indicate where scoring occurs and thin double lines are used to indicate where the blank cutting occurs.

These score and cut lines divide the blank into matched pairs of side panels 62,64,66,68 and end panels 70,72,74,76. A pair of folding corner panels 78–92 are formed between each matched pair of side and end panels, to hinge and connect them together. The corner panels enable and cause the side and end panels to articulate when they are folded. A pair of locking tabs 94,96 are cut into opposing end panels 70,76 for locking the insert when it is in its fully-folded condition.

Figure 2:
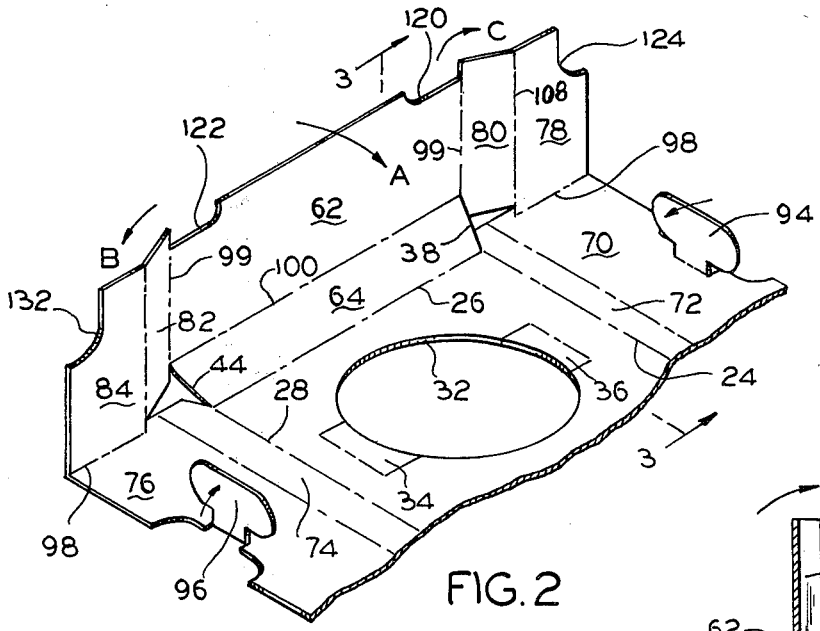
FIG. 2 is a first stop motion view showing how side panels on the blank fold during a first step in an assembly operation.
Figure 3:
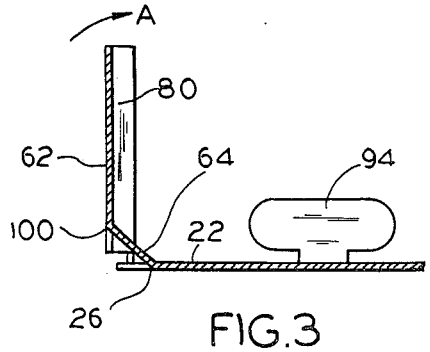
FIG. 3 is a fragmentary cross section taken along line 3—3 of FIG. 2.

To fold and assemble the carton insert, the side panels 62,68 are first lifted in direction A (FIG. 2) and out of the plane of the paper, as viewed in FIG. 1. FIGS. 2 and 3 show the initial articulation of the side panels as they are moved in direction A. In greater detail, the blank is pierced through by four corner cuts at 44,38 (two of which are seen in FIG. 2). The panels 62,64,78,80,82,84 may move independently of each other in the area bounded by these cuts.

The score or crease lines (as at 98) between the bottom of the corner panels and the abutting end panels lies about midway between the score lines 100,26 of the inner ones of the matched pair forming the adjoining side panels 62,64. Hence, as the side panels 62,64 fold in direction A, there is a non-alignment of crease lines forming the hinge or pivot lines for articulation. The panel 64 swings about the hinge formed by the score line 26 and moves through a 90° arc to an upright position which is perpendicular to the central panel 22. Simultaneously, the non-alignment (with respect to crease lines 100,26) of the crease line 98 causes the end panels 78,80,82,84 to swing through a 180° arc about the hinge formed by the crease lines 98.

A continued folding pressure exerted upon panel 62, in direction A, causes the panels 62,64 to crease and pivot along score line 100 so that panels 78,80,62,82,84 begin to move as a single unit and pivot along the hinge formed by the score line 98,98. Score lines 99 are also non-aligned with respect to the score lines forming the inner ones of the matched pairs forming the end panels. As the end panels fold, the inner two corner panels 80,82 begin to fold in directions B and C, respectively, along their scored lines which are not aligned with the hinge lines 99,99. This folding of the end panel accommodates the height differences between the pivoting or hinge action at score lines 98,100. The panel 62 is elevated above panel 22 by the width of the side panel 64, and the end panels 80,82 slope downwardly toward end panels 70,76 as best seen in FIG. 6. To enable this accommodation, the cuts at 44,38 open (FIG. 6) as the panels fold. The proportions are such that the outer two corner panels 78,84 come to rest in face-to-face engagement upon panel 70,76, when the inner side panel 64 is vertical and the forming box has a generally rectangular cross section, as seen in FIG. 5.

Figure 4:
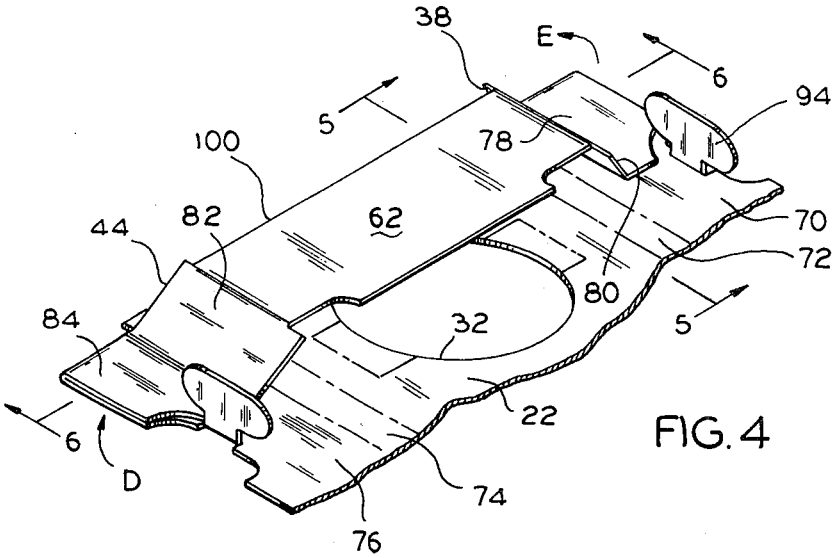
FIG. 4 is a second stop motion view showing the side panels of FIG. 2 folded into their final position and of the end panels beginning to fold.
Figure 5:
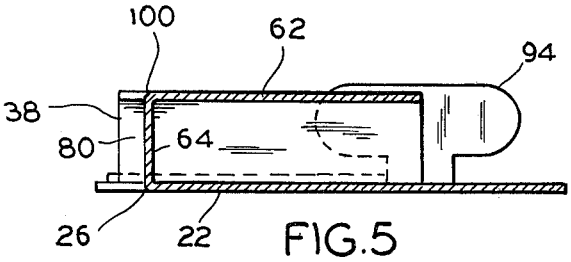
FIG. 5 is a cross section taken along line 5—5 of FIG. 4.
Figure 6:
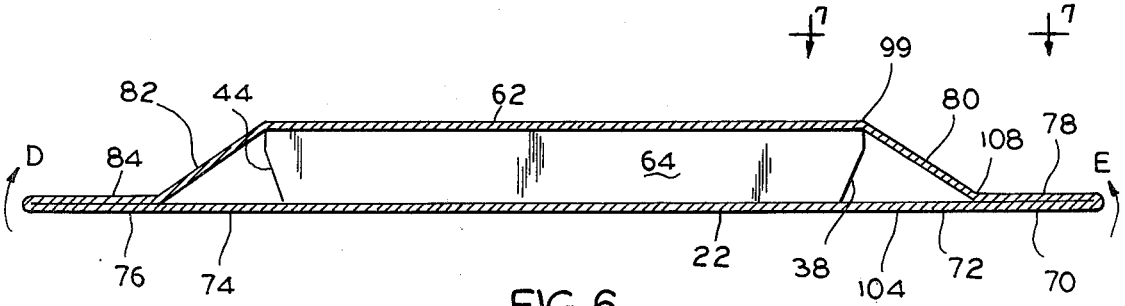
FIG. 6 is a cross section taken along line 6—6 of FIG. 4.
Figure 7:
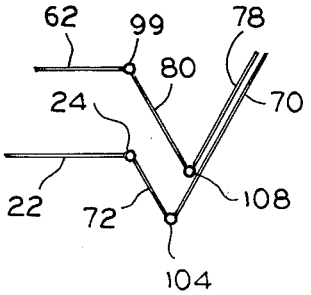
FIG. 7 is a cross section taken along line 7—7 of FIG. 6.

Both of the opposed pairs of side panels 62,64 and 66,68 are folded in the same manner (FIGS. 4,5). Then, the outer end panels 70,76 are raised in the directions D,E. Initially, the inner corner panels 80,82 hold the outer end panels away from the center panels. This forces the end panels 70,72 and 74,76 to begin to pivot relative to each other around the hinge formed by the score lines 104,108 (FIG. 7). As this happens, the corner panels 78,80 begin to articulate about their common score line 108 and about score line 99. This articulation lowers the line 104 relative to the center panel 22, causing the panel 72 to pivot downwardly (as viewed in FIG. 7) about the hinge formed by the score line 24. Thus, at the score line 104, a foot or lower supporting edge is formed for the completely-folded insert.

Figure 9:
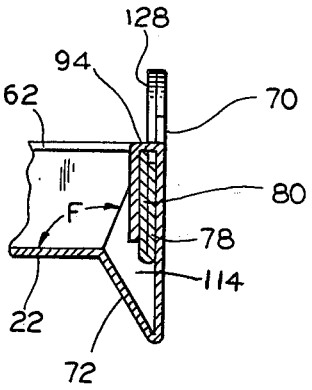
FIG. 9 is a cross-sectional view taken along line 9—9 of FIG. 8 and showing an end of the carton insert in its completely folded position.

The end panels 70,72,74,76 come to rest in abutment with the side panels 62,68. Since the cuts between the side and end panels are formed at an angle F (FIGS. 1 and 9) relative to the score lines, the panels 70,78,80 comprising the end panels do not come into abutment with the central panel 22, and a V-fold is formed between end panels 70,72. Thus, there is a shock-absorbing space 114 over which the end panel must move before it reaches and makes a contact with the central panel 22. The product enclosed within the carton insert will be protected as long as the box is crumpling over the space provided by the V-fold.

Figure 8:
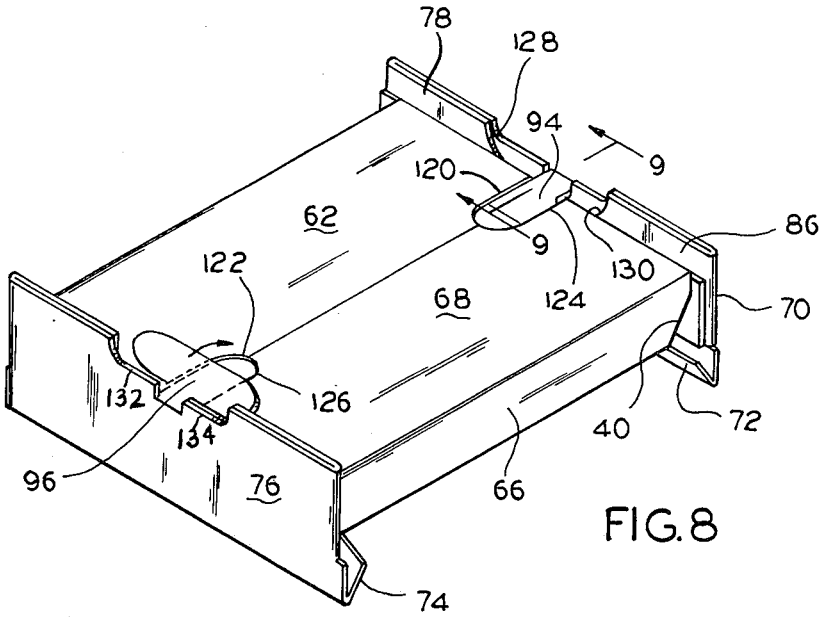
FIG. 8 is a perspective view of the back of the assembled carton insert.
Figure 10:
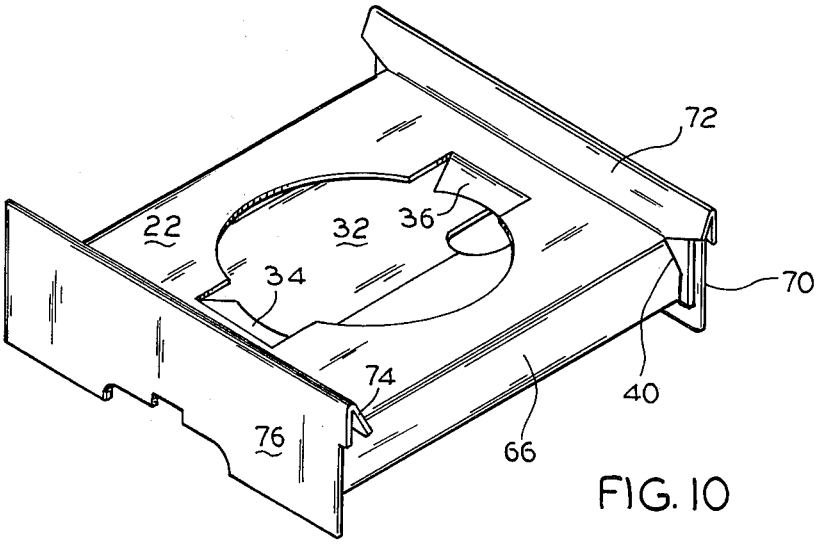
FIG. 10 is a perspective view of the front side of the completely folded carton insert.

It is apparent from an inspection of FIGS. 8, 10 that the end panels are much larger than the dimensions of the box part, so that a product enclosed within the box is held away from all nearby objects and supports, thereby providing a shock-absorbing quality in the box.

FIG. 8 shows the backside of the box or insert after it is completely folded. A number of cutout portions 120–126 come together to form a locking slot opposite the tabs 94,96. Another set of cutouts 128–134 come together to provide a clearance space through which the locking tabs 94,96 may pass as they are bent over the end and pressed into the locking slots 120–126. This completes and locks the carton insert into its final and fully-assembled position.

If the package insert of FIG. 8 is turned over, the appearance is as seen in FIG. 10. The tabs 34,36 on the opposite sides of the hole 32 may be bent downwardly to engage the opposed sides of the product or appliance housed in the package insert. These tabs provide a shock-absorbing quality and an orientation, indexing, locking and stabilization function.

Those who are skilled in the art will readily perceive how to modify the system. Therefore, the appended claim are to be construed to cover all equivalent structures.

I claim:

1. A shock-absorbing carton insert made from a blank having score lines defining a central panel with matched sets of two pairs of opposed side panels and matched sets of two pairs of opposed end panels interconnected by four corner panels, each of said corner panels being defined by hinge-forming score lines which are not aligned with but are spaced between and parallel with score lines forming inner ones of both said matched pairs of side and end panels, whereby said matched pairs of side and end panels form a rectangular, box-like container when the side panels are articulated, the side and end panels being proportioned to fold along said score lines to form erected ends which are much wider than the erected sides in order for the ends to project above and below the box-like container and thereby provide a shock-absorbing quality for a product enclosed within the box.

2. The carton insert of claim 1 wherein the proportions of the various panels are such that when the insert is erected a V-fold is formed along the lower edge of the end panels to raise and support said central panel when in a fully erected position, the space within said V-fold forming an area of collapse which must crumple when the erected insert is subjected to a force in a direction which tends to collapse said V-fold before a product enclosed with the box-like container is damaged.

3. The carton insert of claim 1 wherein an opening is formed in said central panel for receiving a product enclosed within the box-like container forming said insert and tabs formed at the edges of said opening for providing a shock-absorbing quality and an orientation, indexing, locking, and stabilization function.

4. The carton insert of claim 1 and cut lines between a limited portion of the interconnection of said corner panels, said cut lines forming an angle when said insert is erected for holding the end panels spaced away from said box-like container without completely severing the interconnection in order to provide a shock-absorbing space within the erected insert which must crumple before a product contained within the box-like container is damaged.

5. The carton insert of claim 1 and a pair of locking tabs for holding said carton when in a folded position.

* * * * *